United States Patent [19]

Bellafiore

[11] Patent Number: 4,474,135

[45] Date of Patent: Oct. 2, 1984

[54] AUTOTRACK INSULATING MACHINE AND PROCESS

[75] Inventor: Francis V. Bellafiore, Joliet, Ill.

[73] Assignee: Chicago Bridge & Iron Company, Oak Brook, Ill.

[21] Appl. No.: 422,726

[22] Filed: Sep. 24, 1982

[51] Int. Cl.[3] ..... B05B 3/12

[52] U.S. Cl. ..... 118/305; 118/323

[58] Field of Search ..... 239/184, 186, 178, 73; 114/222; 118/207, 108, 305, 323

[56] References Cited

U.S. PATENT DOCUMENTS

| | | | |
|---|---|---|---|
| 1,032,310 | 7/1912 | Swenson | 239/184 |
| 3,863,393 | 2/1975 | Goff | 118/305 X |
| 3,914,077 | 10/1975 | Lodes | 239/186 X |
| 4,333,973 | 6/1982 | Bellafiore et al. | 118/305 X |

*Primary Examiner*—Shrive P. Beck

*Attorney, Agent, or Firm*—Marshall, O'Toole, Gerstein, Murray & Bicknell

[57] ABSTRACT

Apparatus for applying a coating to the exterior surface of a double curved shell which is circular in horizontal section comprising a guide track, having top and bottom ends, adapted to be vertically positioned outwardly from the shell and when so positioned having a contour generally like that of the double curved shell; apparatus at the guide track top and bottom ends for rotating the guide track around the shell about a substantially vertical axis; a carriage mounted on, and movable along a substantial length of, the guide track from which a coating can be applied to the shell; and drive apparatus cooperating with the guide track for driving the guide track around the shell.

A method is also disclosed in which the apparatus is used to apply a series of horizontal circular coating bands on the shell.

1 Claim, 9 Drawing Figures

FIG. 6
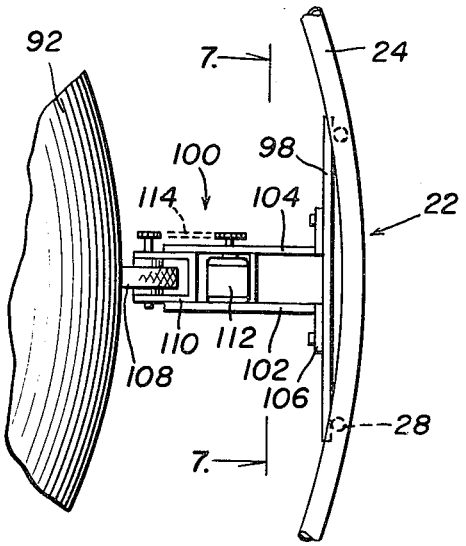
FIG. 7
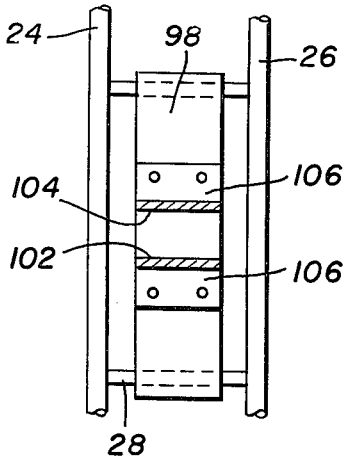
FIG. 8
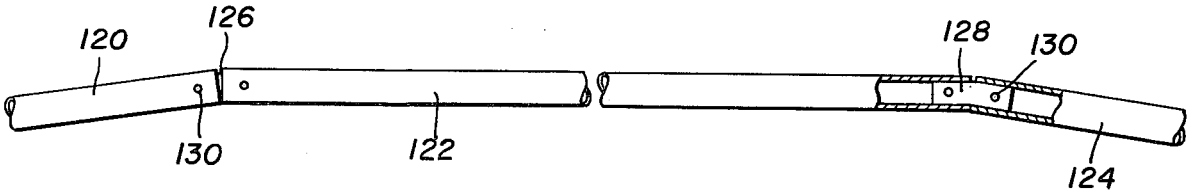
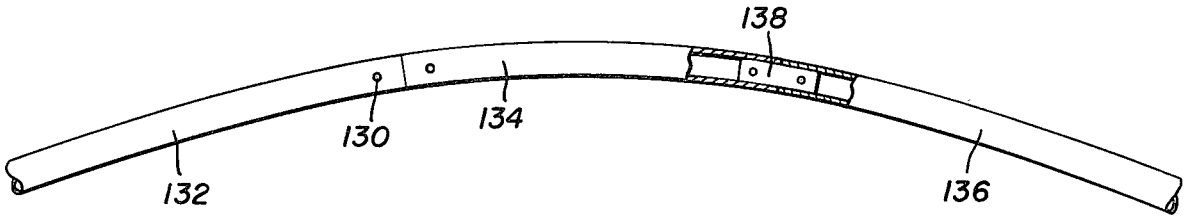
FIG. 9

AUTOTRACK INSULATING MACHINE AND PROCESS

This invention relates to apparatus for, and methods of, coating objects and structures. More particularly, this invention pertains to novel apparatus for, and methods of, coating exterior surfaces of double curved shells, such as those having spherical or spheroidal shapes.

BACKGROUND OF THE INVENTION

Double curved shells, usually of metal, are widely used to store fluids such as water, liquefied gases and liquid petroleum products. The double curved shells are generally spherical or spheroidal in shape. At times it is necessary to place a coating on the shell exterior surface. The coating can be a paint, polymeric film or an insulating layer such as one made of a polymeric material foamed-inplace, especially polyurethane foam.

Because of the large size of many of the shells it is difficult to properly coat their exterior surface because of a lack of support for workmen and essential coating equipment. Present methods employ substantial scaffolding, walk ways and ladders, none of which is easily supported or assembled on the shell because of its shape.

Garis et al U.S. Pat. No. 3,548,453 and Larsen U.S. Pat. No. 3,991,842 disclose apparatus for insulating the exterior vertical walls of cylindrical tanks but they do not disclose a method or apparatus for coating the surface of a double curved shell, either on the interior or exterior surface.

Bellafiore et al U.S. Pat. No. 4,333,973 granted June 8, 1982, discloses a vehicle-like machine for applying foamed-in-place insulation on substantially flat or sloped surfaces using a reciprocating member which applies the foam in adjacent parallel strips or bands in overlapping or side-by-side arrangement.

The Dow Chemical Company apparently produces spheres and hemispheres of rigid plastic foam by a method identified as spiral generation. The method uses a specially designed machine which bends, places and bonds pieces of plastic foam together into a predetermined shape. The machine head is mounted on a boom which swings around a pivot, laying and bonding layer upon layer of foam board in a rising spherical form. The Dow machine use is believed limited, however, to producing walls for truly spherical structures or spherical sections and is apparently not used to coat the shell. Also, since the boom length is apparently constant it would be unsuitable both for forming nonspherical sections which do not have circular sections through the vertical axis and for coating the exterior surface.

From the above discussion it is believed clear that a need exists for novel apparatus and methods which can be used to coat double curved exterior surfaces of shells, such as spherical and spheroidal shells.

SUMMARY OF THE INVENTION

According to one aspect of the invention, there is provided apparatus for applying a coating to the exterior surface of a double curved shell which is circular in horizontal section comprising a guide track, having top and bottom ends, adapted to be vertically positioned outwardly from the shell and when so positioned to have a contour generally like that of the double curved shell; means at the guide track top and bottom ends for rotating the guide track around the shell about a subtantially vertical axis; a carriage mounted on, and movable along a substantial length of, the guide track from which a coating can be applied to the shell; and drive means cooperating with the guide track for driving the guide track around the shell.

Apparatus according to the invention can be used to exteriorly coat double curved shells which are essentially spherical or spheroidal and are supported by one or more columns or legs, a vertical cylindrical skirt or a suitable dished or concave depression. It can also be used to exteriorly coat hemispherical or hemispheroidal shells or shell portions, such as domes.

The guide track top end can usually be readily attached to the top center of the shell to be coated so as to rotate or pivot in a complete circle or any part of a circle.

The guide track bottom end can remain free to move on the shell surface and rotate partially or wholly around the shell. One or more wheels can be located on the guide track bottom end or spaced upwardly therefrom to support it outwardly from the shell surface. Furthermore, one or more of the wheels can be a drive wheel to move the guide track along the shell. Such an arrangement is particularly useful when the track lower end is not substantially below the equator of the shell. When a shell surface below a shell equator is to be coated, the guide track bottom end will generally be attached to the shell by a retaining support.

Apparatus for coating the exterior surface of a double curved shell which is spherical or spheroidal and is supported by a column can include means at the guide track top end adapted to be pivotally joined to the top of the tank, with the means at the guide track bottom end for rotating the track including a collar mountable on the column.

The guide track can comprise a single rail, or two spaced apart parallel rails, to which the carriage is mounted. The carriage can be mounted to roll or slide along the rails.

The apparatus will also generally include means to move the carriage along the guide track to stop it at a series of positions. The means to move the carriage along the track can include a flexible line extending from the carriage to a winch near the top of the guide track.

The apparatus drive means can be mounted on the guide track and include a drive wheel adapted to frictionally contact the shell or a collar on the shell. The drive means can be located anywhere, but generally will be positioned at, or above, the bottom end of the track. The guide track can have at least two stations or mountings between the ends of the guide track to which the drive means can be removably and selectively attached.

According to a second aspect of the invention there is provided a method of applying a coating to the exterior surface of a double curved shell which is circular in horizontal section comprising positioning around the shell, apparatus comprising a guide track, having top and bottom ends, so that it is vertically arranged outwardly from the shell, with said track having a contour generally like that of the double curved shell; securing the guide track to the shell for rotating the guide track on the shell about a substantially vertical axis; positioning a carriage, from which a coating can be applied to the shell, on the guide track; rotating the guide track about its vertical axis while applying a coating from the carriage to the shell surface as a horizontal band extending circumferentially around the shell surface; positioning the carriage on the track adjacent an area of the shell surface which has not been so coated; rotating the track about its vertical axis while applying a coating from the carriage to the shell surface as a second horizontal band extending circumferentially around the shell surface; and repeating the described application of coating bands until a substantial portion of the shell surface is coated.

In practicing the method successive coating bands generally will be placed adjoining previously applied coating bands.

When the shell is centrally supported at the bottom, the method can be continued until a dished circular area on the shell top, bottom or both, remains uncoated. This dished circular area can then be coated by manual application without use of the apparatus.

The method is particularly useful when the coating is a foamed in place insulating material, such as a polymeric foam.

Regardless of the nature of the coating, each horizontal coating band can be applied by spraying the coating on in rapid vertical passes.

BRIEF DESCRIPTION OF THE DRAWINGS

FIG. 6 is an enlarged view of the power drive mechanism mounted on the coating apparatus guide track;

FIG. 7 is a sectional view taken along the line 7—7 of FIG. 6;

FIG. 8 is a view of a sectional rail which can be used in the coating apparatus guide track in which the rail sections are straight; and FIG. 9 is a view of a sectional rail in which the rail sections are curved or arced.

DETAILED DESCRIPTION OF THE DRAWINGS

Figure 2:
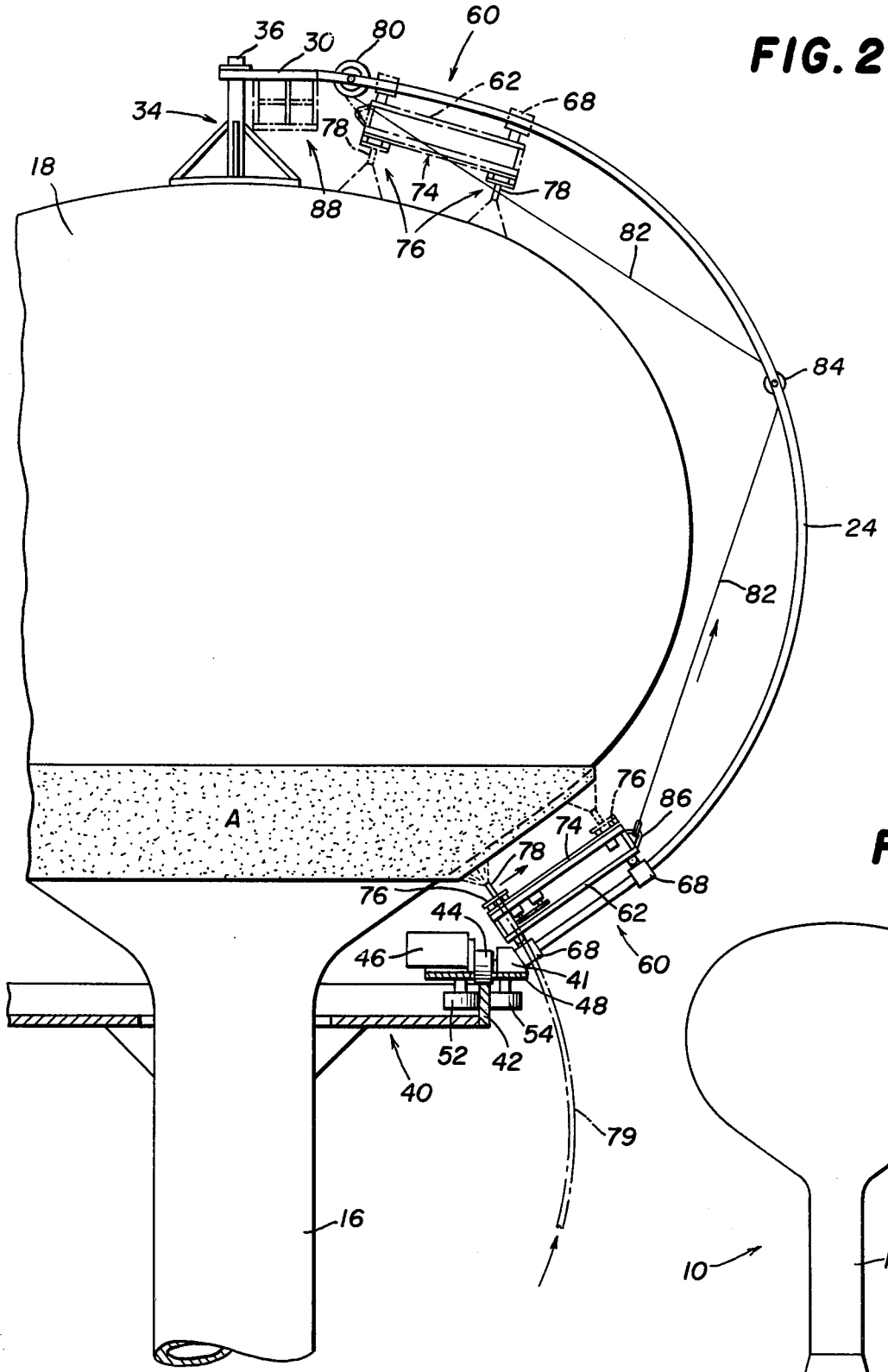
FIG. 2 is an enlarged partial view of the water storage tank spheroidal top shown in FIG. 1 with coating apparatus provided by the invention mounted thereon.

To the extent it is reasonable and practical, the same or similar elements in the various views of the drawings will be identified by the same numbers.

With reference to FIGS. 1 to 4, the water storage tank 10 has a truncated conical metal base 12 supported on a foundation 14, a circular cylindrical metal column 16 joined to the base, and a metal hollow spheroidal top 18 supported on the column.

The embodiment of coating apparatus 20 shown in FIGS. 1 to 5 can be used to coat the spheroidal top 18 with a paint, one or more layers of a polymeric insulating foam, or some other coating. The subsequent description of the apparatus, however, will be directed to its use in applying insulating polymeric foam, such as foamed-in-place polyurethane foam, on the spheroidal top 18. Insulating spheroidal top 18 is desirable at times to keep stored water from freezing in cold climates, to keep cold water from being heated in hot climates and to keep heated water from cooling.

The coating apparatus 20 includes a guide track 22 having a pair of spaced apart essentially identical curved rails 24 and 26 which are maintained fixedly parallel to each other by a series of lateral braces 28. The upper end of the guide track 22 has a pair of angled members 30 which extend to and are connected to a shaft receiving collar 32.

Removably mounted on the top center of spheroidal top 18 is a stand 34 having a vertical shaft 36 extending upwardly centrally therefrom. Collar 32 at the upper end of track 22 is rotatably mounted on shaft 36 so as to keep the upper end of the track 22 a fixed distance above the spheroidal top 18 surface while permitting the track to rotate 360° around the top 18.

A support 40 for the lower end of guide track 22 is removably mounted near the top of column 16 but below the bottom of spheroidal top 18. The support 40 includes a vertically positioned ring 42.

A pair of rollers 44 is mounted on blocks 41 on the ends of rails 24 and 26 so as to ride on top of ring 42. One of the rollers 44 is driven by a power means, which includes motor 46, to drive the track around the tank spheroidal top 18.

A plate 48 is mounted to blocks 41 and it provides a base for motor 46 and a support for a pair of guide rollers 52 and 54 which are mounted so as to roll against, but on opposite sides, of ring 42. The rollers 44, 52 and 54 maintain the guide track at a fixed distance spaced out from the spheroidal top 18 surface yet they permit rotation of the guide track 22 around the tank.

Carriage 60 is slidably mounted on the underside of guide track 20. Carriage 60 includes a central frame 62 with lateral arms 64 and 66 extending from each end. Each end of each arm 64 and 66 is equipped with a linear bearing mounting 68 of a commercially available type. One type of linear bearing which can be used is disclosed in U.S. Pat. No. 4,334,716 granted June 15, 1982. The linear bearings are adapted to be mounted to the respective rails 24 and 26, which desirably are tubular and circular in lateral section.

Suspended from the carriage central frame 62 is a rack 74 supporting a drive mechanism which moves a spray gun mounting 76 reciprocally back and forth in line with the carriage length. Thus, when insulating foam spray gun 78 is fastened to mounting 76 it moves in a reciprocal manner as described. My U.S. Pat. No. 4,333,973 granted June 8, 1982, the entire content of which is incorporated herein by reference, discloses such a mechanism for depositing insulating foamable liquid on a surface to be insulated.

A winch 80 is mounted on the guide track 22 near its upper end. A wire rope 82 is run from winch 80 over one or more pulleys 84 to metal eye 86 on the upper end of carriage 60. A work platform 88 is also mounted on guide track 22 near its top so that an operator can supervise the operation of the apparatus.

Figure 1:
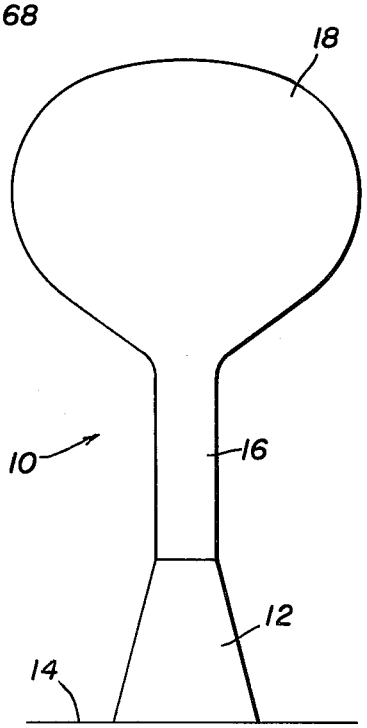
FIG. 1 is an elevational view of a single pedestal water storage tank having a spheroidal top.
Figure 4:
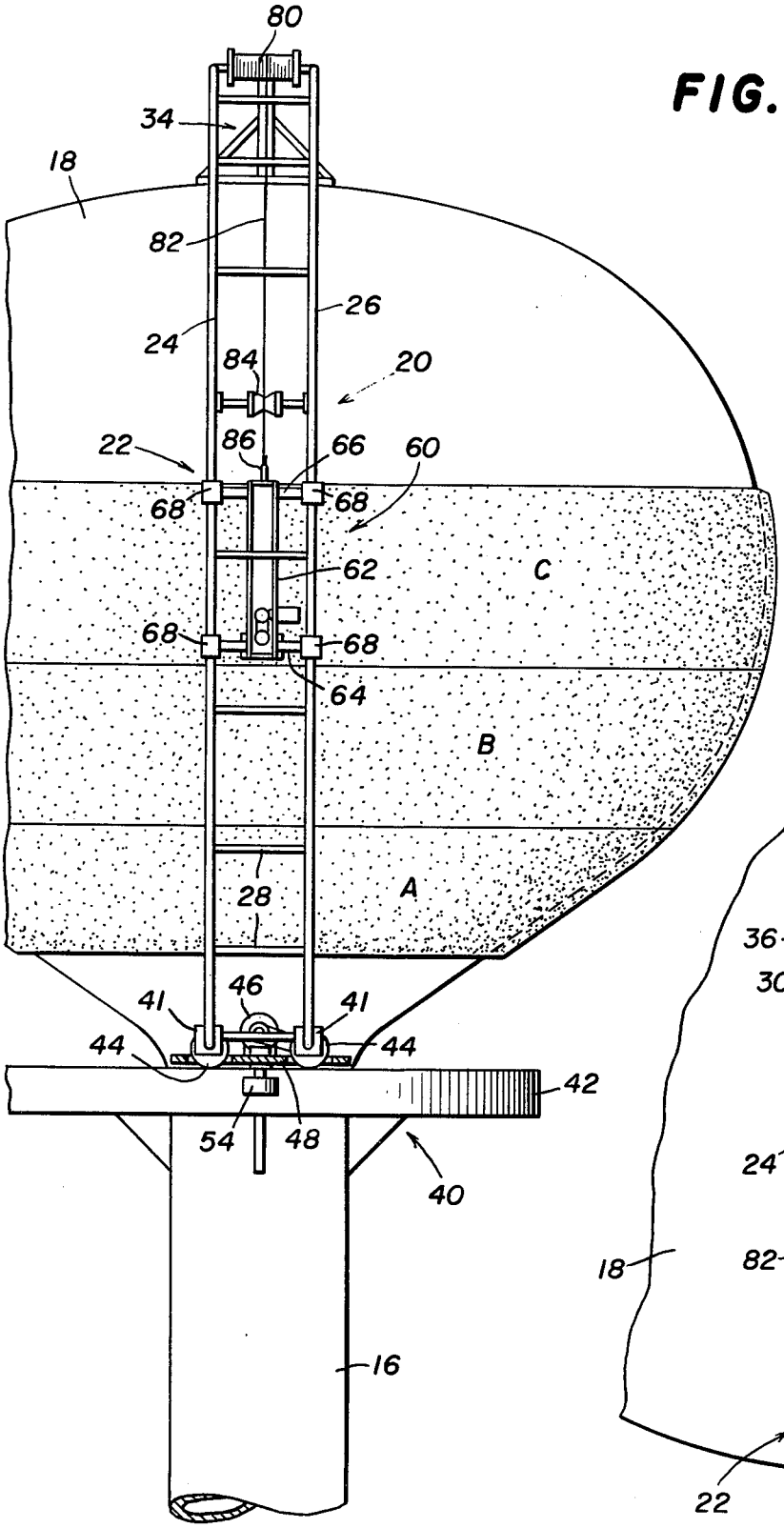
FIG. 4 is similar to FIG. 1 but it shows the coating apparatus in front elevational view.
Figure 3:
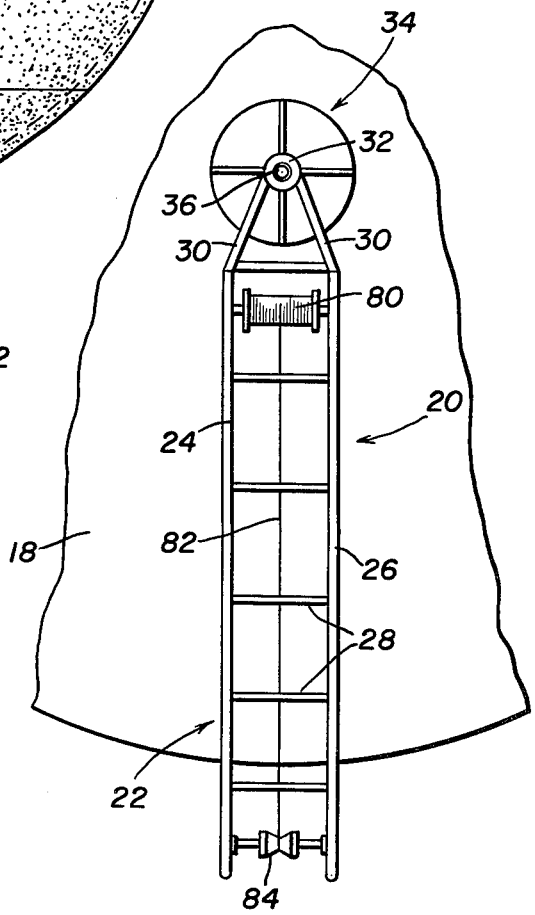
FIG. 3 is a partial plan view of the tank of FIG. 1 showing the coating apparatus thereon.

The storage tank 10 illustrated in FIG. 1 has not had the apparatus of the invention mounted thereon nor has the spheroidal top 18 been coated with insulating foam. FIGS. 2 and 3 show the apparatus mounted on the tank and with a horizontal band of insulation foam being deposited on the lower part of spheroidal top 18. The horizontal band A of insulation is applied by reciprocal movement of spray gun 78 in a line parallel to the tank axis while the guide track 22 is caused to rotate about shaft 36 by applying power to drive wheel 44. Foamable insulating liquid is supplied to spray gun 78 through conduit 79.

After the horizontal band A of insulation foam has been deposited, the spray gun is stopped temporarily while winch 80 applies tension to wire rope 82, thereby causing carriage 60 to slide or roll upwardly into position for deposit of the next horizontal insulation foam band. While the next band will generally be placed adjacent the previously deposited band, it is not necessary that they be applied consecutively side-by-side one after the other, such as in the order of bands A, B and C shown in FIG. 4. Thus, it is feasible to deposit band A, then band C followed by band B or to deposit them in any other suitable order. Furthermore, it is not essential that the individual bands all be of the same height. The height of the bands can be increased or decreased as desired within the capability of the reciprocating mechanism which transports the spray gun 78.

The thickness of the expanded insulating foam deposited on the spheroidal top 18 will usually be from 2 to 6 inches thick. The insulating foam can be deposited as a single layer or as a plurality of layers sucessively applied.

It should be understood that wire rope 82 will be mounted on one or more pulleys 84 removably located at various positions on guide track 22 to permit movement of the carriage 60 along essentially the full length of the guide track 22.

After as much as possible of the spheroidal top 18 has been insulated by use of the guide track 22 and carriage 60, the apparatus can be removed. Then the circular area on the top center of the tank can be insulated by manually depositing foamable insulating liquid. Similarly, the area of the spheroidal top 18 below band A can be insulated manually as described.

Figure 5:
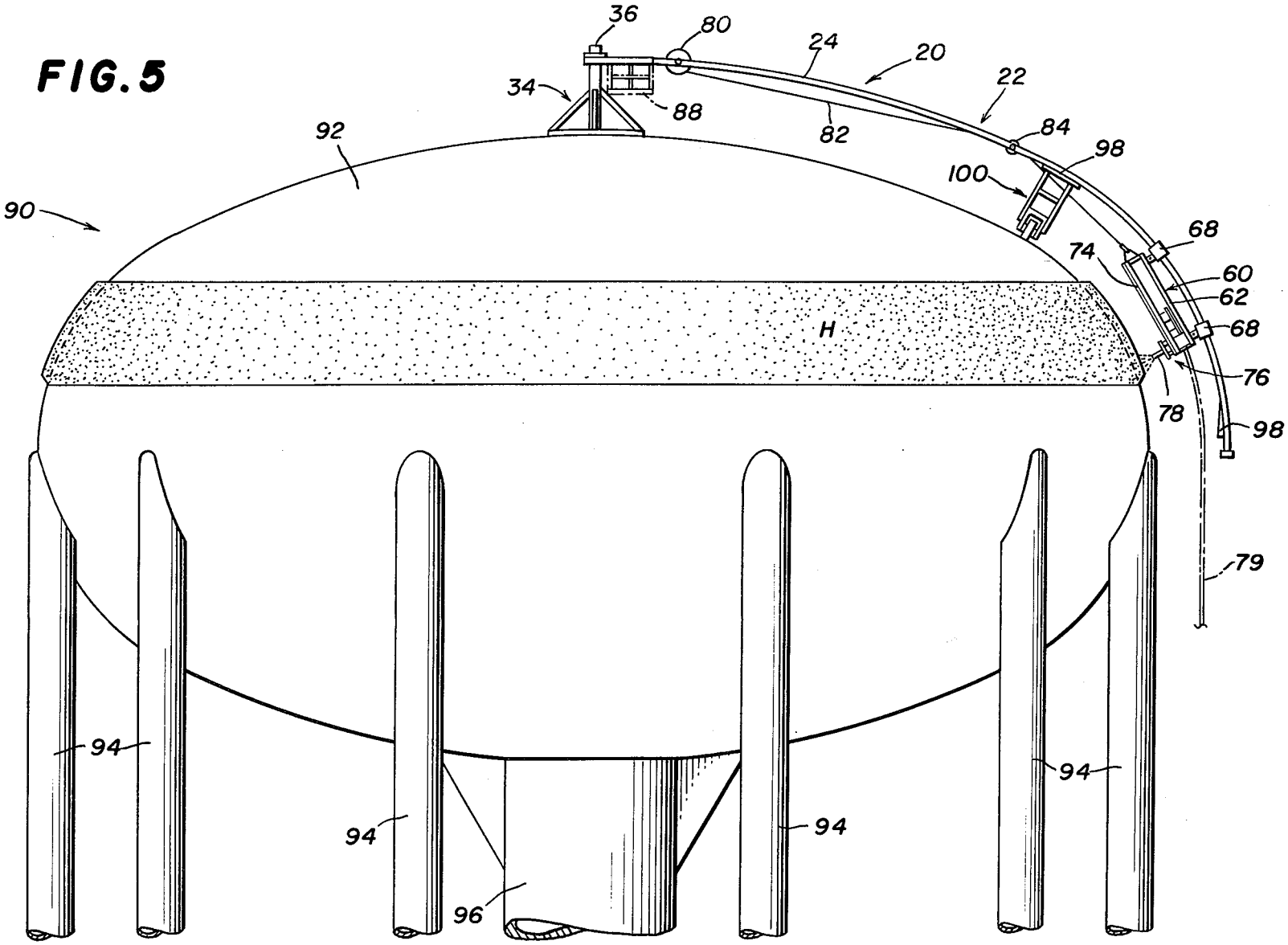
FIG. 5 is an elevational view of the upper part of a multi-column supported spheroidal water storage tank having a second embodiment of coating apparatus according to the invention mounted thereon.

FIGS. 5 to 7 illustrate another embodiment of apparatus for coating double curved surfaces.

FIG. 5 illustrates a water storage tank 90 having a large spheroidal shell 92 supported around its periphery by a plurality of vertical tubular columns 94 and a large central vertical tubular column 96. Mounted on tank 90 is a guide track 22 essentially like that shown in FIGS. 2 to 4. The guide track 22 mounted on tank 90, however, hangs free and has no drive means or guide rollers permanently attached to the track lower end. Instead, the guide track 22 is provided with two or more spaced apart drive unit mounts 98 on which drive unit 100 can be removably mounted.

Drive unit 100 has a pair of spaced apart legs 102 and 104 with flanges 106 on the end which can be bolted or otherwise be removably connected to mount 98. Drive wheel 108 is mounted on an axle supported in bearings on frame 110 connected to legs 102 and 104. Motor 112 drives chain 114 which meshes with a sprocket on the axle supporting drive wheel 108 to thereby provide power to the wheel 108 which contacts the surface of spheroidal shell 92.

The construction and operation of carriage 60 on the guide track 22 shown in FIGS. 5 and 6 is the same as described above in connection with FIGS. 2 to 4 so it will not be repeated.

The apparatus illustrated in FIGS. 5 to 7 is first put in position with the drive mechanism 100 located on the guide track so as to permit deposit of one or more horizontal bands of insulation at any predetermined area on spheroidal tank 92. Power is then applied to motor 112 to rotate drive wheel 108 and thereby cause the guide track 22 to rotate about shaft 36. Once rotation of the guide track starts, the spray gun can be activated to spray expandable insulating foam in a band H on the surface of spheroidal shell 92. The band H can be applied lower or higher than shown on FIG. 5 as may be appropriate for a particular tank and for any other reasons.

After the spheroidal shell 92 has been insulated by use of the described apparatus from the top of columns 94 to near support 34, the guide track 22 and support are removed. Then the circular area on the top of shell 92 is insulated manually as is the area of shell 92 below the tops of columns 94.

FIGS. 8 and 9 illustrate rail constructions which can be used in making the guide track 22. The rails shown in FIG. 8 are made of straight tubular circular sections 120, 122 and 124 which may be of the same or different lengths. The adjacent ends of the sections are joined together by angled inserts 126 and 128 which telescope into the ends of the sections. Bolts or pins 130 extending through the walls of the sections and the inserts can be used to removably secure the sections together. Angled inserts 126 and 128 can be angled to the same extent or angled differently so as to facilitate assemblying a guide track which has a contour close to that of the shell surface to be insulated, whether the shell surface is uniformly arced vertically or not.

FIG. 9 is similar to FIG. 8 but shows the tubular sections 132, 134 and 136 arced and with the inserts 138 also arced. The tubular sections 132, 134 and 136 can be the same or different lengths and can be arced or curved the same or differently. Furthermore, the inserts 138 can be identically curved or curved differently to facilitate construction of a guide track suitable for use on a particularly curved tank.

The foregoing detailed description has been given for clearness of understanding only, and no unnecessary limitations should be understood therefrom as modifications will be obvious to those skilled in the art.

What is claimed is:

1. Apparatus for applying a coating to the exterior surface of a double curved shell which is spherical or spheroidal and is cicular in horizontal section and is supported by a column, comprising:

a guide track, having top and bottom ends, adapted to be vertically positioned outwardly from the shell and when so positioned having a contour generally like that of the double curved shell;

means at the guide track top end adapted to be pivotally joined to the top of the tank for rotating the guide track around the shell about a substantially vertical axis;

roller means connected to the guide track bottom end for rotating the track and including a collar mountable on the column so as to maintain the guide track a predetermined distance from the shell and support the guide track so it can roll horizontally around the shell in contact with the collar;

a carriage mounted on, and movable along a substantial length of, the guide track from which a coating can be applied to the shell; and drive means supportably and operatively joined to the guide track for driving the guide track around the shell.

* * * * *